United States Patent [19]

Riehl, Jr.

[11] Patent Number: 4,550,740

[45] Date of Patent: Nov. 5, 1985

[54] MOUTHPIECE FOR A CIGARETTE AND A CIGARETTE HAVING SAME

[75] Inventor: Tilford F. Riehl, Jr., Louisville, Ky.

[73] Assignee: Brown & Williamson Tobacco Corporation, Louisville, Ky.

[21] Appl. No.: 558,414

[22] Filed: Dec. 5, 1983

[51] Int. Cl.[4] ..... A24D 3/04

[52] U.S. Cl. ..... 131/336; 131/339; 131/341; 131/361

[58] Field of Search ..... 131/364, 336, 361, 339, 131/341

[56] References Cited

U.S. PATENT DOCUMENTS

| | | | |
|---|---|---|---|
| 3,059,649 | 10/1962 | Bernhard | 131/364 |
| 3,394,708 | 7/1968 | Grassi | 131/336 |
| 3,596,663 | 8/1971 | Schultz et al. | 131/336 |

*Primary Examiner*—V. Millin

*Attorney, Agent, or Firm*—Charles G. Lamb

[57] ABSTRACT

A mouthpiece adapted to be attached to a smoking article, such as a cigarette, includes, in one advantageous embodiment, an air impermeable core member of smaller diameter than the tobacco column to which it is to be coaxially located and a generally cylindrically shaped hollow sleeve having generally the same diameter as the tobacco column concentrically located over the impermeable core member and cooperating therewith to define a generally annular channel open at both of its ends. The mouthpiece is connected to the tobacco column by circumscribing air permeable tipping material therearound. In one embodiment, the mouthpiece includes a filter plug coaxially located at one end of the tobacco column with the filter plug being of generally the same diameter as the tobacco column. The filter plug has generally longitudinally extending grooves formed in the peripheral surface extending from one end to the other end of the filter plug. An air and smoke impermeable core member having a smaller diameter than the filter plug is located with its generally circular end in coaxial juxtaposition with the end of the filter plug opposite the tobacco column. A generally cylindrical sleeve having a diameter generally the same as the filter plug is concentrically located over the impermeable core member and cooperates with the core member to define a generally annular channel open at both of its ends. The mouthpiece is attached to the tobacco column by circumscribing air permeable tipping material therearound.

10 Claims, 7 Drawing Figures

MOUTHPIECE FOR A CIGARETTE AND A CIGARETTE HAVING SAME

BACKGROUND OF THE INVENTION

1. Field of the Invention

The present invention relates to smoke diluting devices, and more particularly to a mouthpiece for a cigarette, or the like, which reduces tar almost exclusively by ventilation.

2. Description of the Prior Art

It is well known in the art to add filters to cigarettes wherein the filters are provided with ventilating means to bring ambient air into the filter to dilute the smoke flowing through the filter. The dilution of the smoke reduces the quantity of smoke particulates as well as gas phase components which are delivered to the mouth of the smoker.

Another method for diluting the smoke is to make the tobacco column wrapper material permeable to air which allows for the introduction of air along the entire length of the tobacco column where it mixes with the smoke stream passing through the tobacco column thereby diluting the smoke.

Yet another method is to provide generally longitudinal ventilation air grooves in the periphery of a filter which grooves are open to the mouth end of the filter. The filtered smoke leaving the mouth end of the filter is mixed with the ventilation air exiting the ventilation air grooves in the smoker's mouth whereat the smoke is diluted. Examples of cigarette filters having grooves for the introduction of ventilating air into the filtering end are shown in the following Patents: U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 3,910,288; and, U.S. Pat. No. 4,256,122.

It has also been proposed to provide a cigarette filter which delivers a combination of air diluted filtered smoke and undiluted, unfiltered smoke to the smoker's mouth. One such cigarette filter is shown in U.S. Pat. No. 3,860,011 as being formed of a hollow filter including a rigid non-deformable tube defining a smoke passage for delivering unfiltered smoke to the smoker's mouth, a concentric layer of filter material surrounding the tube, and a perforated outer wrap for the passage of air into the layer of filter material.

Devices for diluting unfiltered smoke with ventilating air before the smoke enters a smoker's mouth are also known. One example of such a device is shown in U.S. Pat. No. 3,552,399. The device, therein referred to as a filter for homogenizing air and smoke has a blind ended, longitudinal central axial passageway open to either the smoker's mouth or a filter element, a plurality of longitudinal passageways surrounding and extending parallel to the central passageway, and transverse passageways interconnecting the longitudinal passageways and central passageway with each other and with the ambient air. As the cigarette to which the device is attached is smoked, smoke and ambient air traverse the longitudinal and central passageways wherein the smoke and air are mixed before delivery to the smoker's mouth.

Devices are also known for delivering unfiltered smoke and ventilation air to the smoker's mouth. For example, U.S. Pat. No. 4,023,576 teaches a cigarette with a hollow mouthpiece which defines a smoke chamber. The smoke chamber is separated from the tobacco column by two spaced apart baffle plates which define a curved path which the smoke must traverse before entering the smoke chamber. The mouth end of the chamber is closed by a wall having a central orifice for the flow of smoke out of the smoke chamber into the smoker's mouth. The exterior surface of the mouthpiece is provided with longitudinal grooves which cooperate with an overlaying perforated tipping paper to define flow paths for ventilating air. When a smoker draws on the mouthpiece, undiluted, unfiltered smoke is drawn from the tobacco column into the smoke chamber and through the outlet orifice centrally of the mouthpiece and into the smoker's mouth. At the same time, ventilation air is drawn in through the tipping paper and longitudinal grooves to mix with the undiluted smoke within the smoker's mouth.

SUMMARY OF THE INVENTION

The present invention advantageously provides a straightforward arrangement of a mouthpiece for a cigarette for lowering tar primarily by ventilation with ambient air. The present invention also provides a mouthpiece for a cigarette which enhances the perceived taste of a cigarette while lowering tar by ventilation.

More particularly, the present invention provides a mouthpiece for a cigarette comprising an air and smoke impermeable core member having at least one end of generally circular shape of a smaller diameter than the tobacco column of the cigarette adapted to be located in generally coaxial juxtaposition to one end of the cigarette tobacco column, a generally cylindrically shaped sleeve member having generally the same diameter as the cigarette tobacco column concentrically located over the core member and cooperating therewith to define a generally annular chamber open at both of its ends, and means for supporting the sleeve member in coaxial, radially spaced relationship over the core member.

The present invention further provides a mouthpiece for a cigarette comprising a generally cylindrical filter plug adapted to be coaxially located at one end of the tobacco column of the cigarette, the filter plug being generally the same diameter as the tobacco column, a plurality of generally longitudinally extending grooves formed in the periphery of the filter plug extending from one end to the other end of the filter plug, the grooves being spaced apart circumferentially of the filter plug, an air and smoke impermeable core member having at least one end of generally circular shape having a smaller diameter than the filter plug disposed with its generally circular end in generally coaxial juxtaposition with the end of the filter plug opposite the cigarette tobacco column, a generally cylindrically shaped hollow sleeve member having generally the same diameter as the filter plug concentrically located over the core member and cooperating therewith to define a generally annular channel open to both of its ends, and means for supporting the sleeve member in position over the core member.

The present invention also provides a cigarette comprising a generally cylindrically shaped tobacco column, an air and smoke impermeable core member having at least one end of generally circular shape having a smaller diameter than the tobacco column located in coaxial juxtaposition to one end of the tobacco column, a generally cylindrically shaped hollow sleeve having generally the same diameter as the tobacco column concentrically located over the core member and cooperating therewith to define a generally annular channel open at both of its ends, means for supporting the sleeve member in position over the core member, tipping material circumferentially surrounding at least a portion of the sleeve and overlapping at least the portion of the tobacco column adjacent to the sleeve member attaching the sleeve member to the tobacco column, and means providing for the flow of ambient ventilating air through the wall of the tobacco column and into the interior of the tobacco column.

The present invention yet further provides a cigarette comprising a generally cylindrically shaped tobacco column, a filter plug coaxially located at one end of the tobacco column, the filter plug being generally the same diameter as the tobacco column, a plurality of generally longitudinally extending grooves formed in the periphery of the filter plug extending from one end to the other end of the filter plug, the grooves being spaced apart circumferentially of the filter plug, an air and smoke impermeable core member having at least one end of generally circular shape having a smaller diameter than the filter plug disposed with its circular end in coaxial juxtaposition with the end of the filter plug opposite the tobacco column, a generally cylindrically shaped hollow sleeve member having substantially the same diameter as the filter plug coaxially located over the core member and cooperating therewith to define a generally annular channel open at both of its ends, means for supporting the sleeve member in position over the core member, tipping material circumferentially surrounding the filter plug, at least a portion of the sleeve member overlapping at least the portion of the tobacco column adjacent to the filter plug attaching the sleeve member and filter plug to the tobacco column, and means providing for the flow of ambient ventilating air through the tipping material into at least the grooves formed in the filter plug.

BRIEF DESCRIPTION OF THE DRAWINGS

The various features and advantages of the present invention will become even more clear upon reference to the following description and accompanying drawings wherein like numerals refer to like parts throughout, and in which.

DESCRIPTION OF THE PREFERRED EMBODIMENTS

Figure 1:
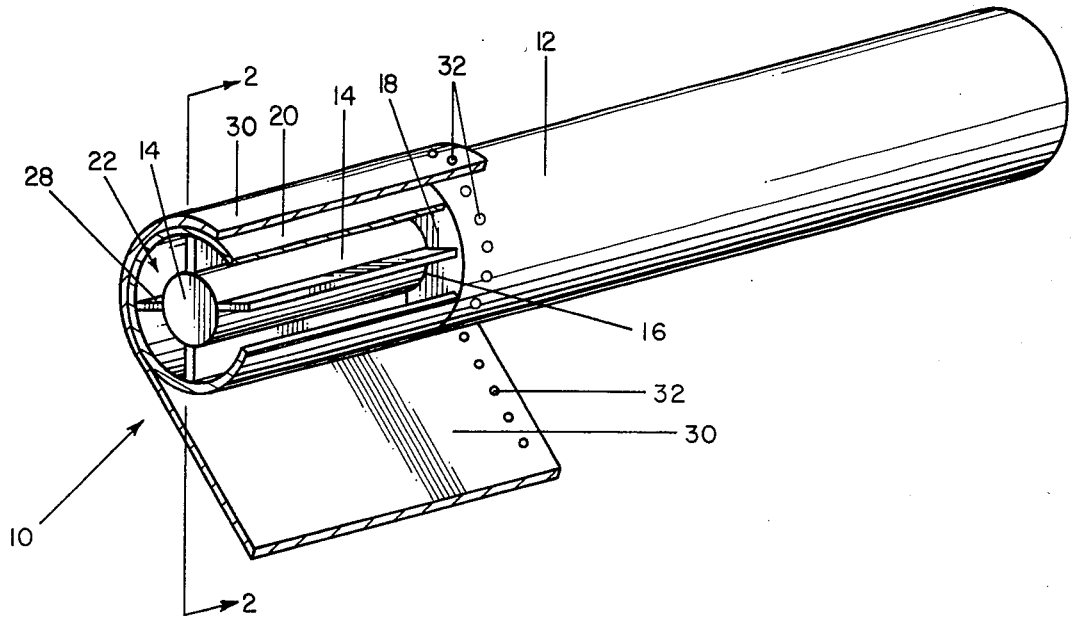
FIG. 1 is a perspective view of one advantageous embodiment of a mouthpiece of the present invention attached to a cigarette tobacco column, the tipping material being shown as partially unwound to more clearly show details.
Figure 2:
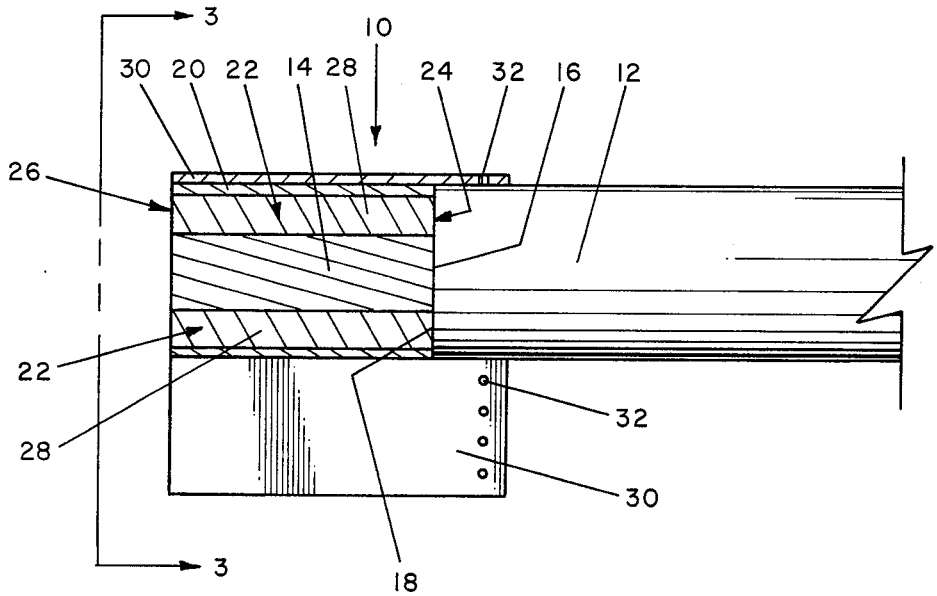
FIG. 2 is a longitudinal cross-sectional view of the mouthpiece of FIG. 1 as viewed in the direction of arrows 2—2 in FIG. 1.
Figure 3:
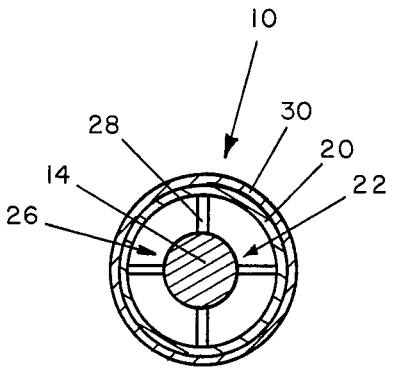
FIG. 3 is an end view of the mouthpiece as viewed in the direction of arrows 3—3 in FIG. 2.

FIGS. 1 through 3 show one advantageous embodiment of a mouthpiece, generally denoted as the numeral 10, of the present invention attached to a cigarette tobacco column 12.

The mouthpiece 10 is shown as including an air and smoke impermeable core member 14 having at least one generally circular shaped end 16 with a smaller diameter than the tobacco column 12 located in generally coaxial juxtaposition to one end 18 of the tobacco column 12. As shown, the core member 14 is generally cylindrical in shape although it is contemplated that other shapes such as, for example, a conical shape can be employed. A cylindrically shaped sleeve member 20, which is also air and smoke impermeable, having an outside diameter about 0.3 mm smaller than the cigarette tobacco column 12 and an inside diameter greater than the diameter of the circular end of the core member 14 is concentrically located over the core member 14 and cooperates with the core member 14 to define a generally annular channel 22. The annular channel 22 is open at both of its ends 24 and 26. One open channel end 24 is open to the end 18 of the tobacco column 12 and the other open channel end 26 is open to the mouth end of the mouthpiece 10. As shown, the sleeve member 20 is longitudinally coextensive with the core member 14.

Support means, such as a plurality of spaced apart, generally radially extending webs 28 interconnecting the core member 14 and sleeve member 20 across the annular channel 22 hold the sleeve member 20 in position over the core member 14. Preferably, the webs 28 are integrally formed with the core member 14 and sleeve member 20.

The core member 14, sleeve member 20 and webs 28 can be manufactured by extrusion and fabricated by virtually any air and smoke impermeable material, such as, for example, a plastic.

Tipping material 30, for example, of the type well known in the art, such as a sheet of paper, circumferentially surrounds at least a portion of the sleeve member 20 and overlaps at least the portion of the tobacco column 12 adjacent to the sleeve member 20 attaching the sleeve member 20 to the tobacco column 12. As is well known in the art, the tipping material 30 can be secured to the sleeve member 20 and the overlapped portion of the tobacco column 12 by an adhesive.

The tipping material 30 overlapping the tobacco column 12 and the wall of the overlapped portion of the tobacco column 12 is air permeable. As shown in FIGS. 1 and 2, the air permeability is accomplished by, for example, small air flow perforations 32 formed through the tipping material 30 and wall of the tobacco column 12, near the end 18 of the tobacco column adjacent to the sleeve member 20. Alternatively the tipping material 30 and the tobacco column wall can be fabricated of a porous material. Alternatively, the perforations 32 can be formed through the wall of the tobacco column 12 upstream of the edge of the tipping material 30.

It has been found that to assure secure fastening of the sleeve member 20 to the tobacco column 12 it is advantageous to employ a circumscribing layer of wrapper material (not shown) between the peripheral surface of the sleeve member 20 and the tipping material 30. An example of such a wrapper material is air permeable plug wrap.

When a smoker draws on the mouthpiece 10, ventilating air is drawn into the tobacco column 12 through the perforations 32 near the end 18 of the tobacco column 12, mixing with the smoke traveling along the tobacco column 12. The diluted smoke enters the annular channel 22 through the open channel end 24 and leaves the annular channel through the opposite open annular channel end 26 entering the smoker's mouth in a concentrated toroidally shaped stream from the periphery of the mouth end of the mouthpiece 10.

Figure 4:
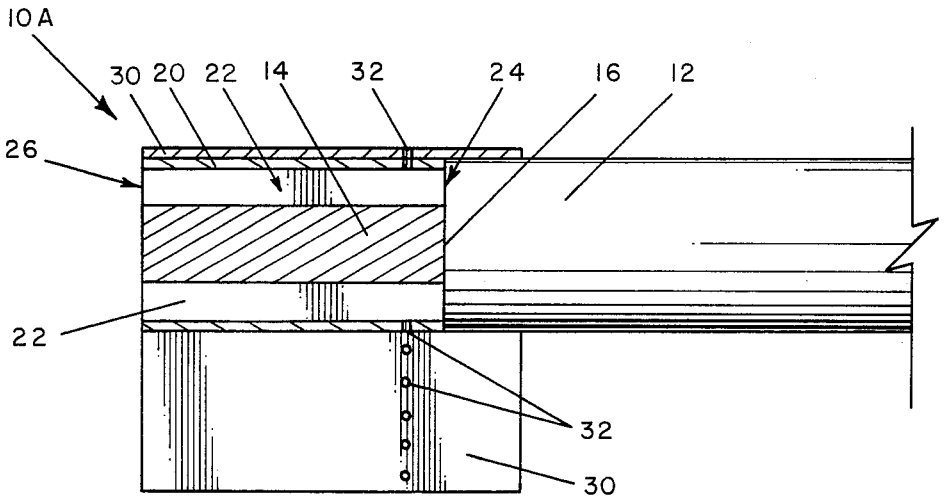
FIG. 4 is a longitudinal cross-sectional view of a mouthpiece similar to that shown in FIGS. 1–3 with some modification.

FIG. 4 illustrates a mouthpiece 10A similar in virtually every respect to the mouthpiece 10 of FIGS. 1–3 with the exception that the air ventilation perforations 32 are formed through the tipping material 30 and sleeve member 20 to provide for the flow of ventilating ambient air into the annular channel 22 downstream of the tobacco column 12 instead of into the tobacco column 12.

Figure 5:
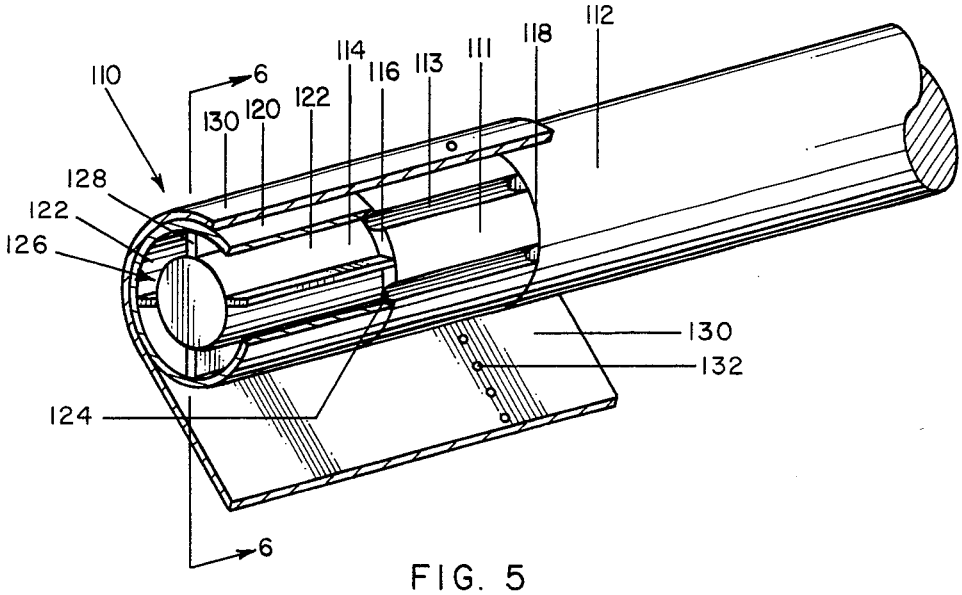
FIG. 5 is a perspective view of another advantageous embodiment of a mouthpiece of the present invention attached to a cigarette tobacco column, the tipping material being shown partially unwound to more clearly show details.
Figure 6:
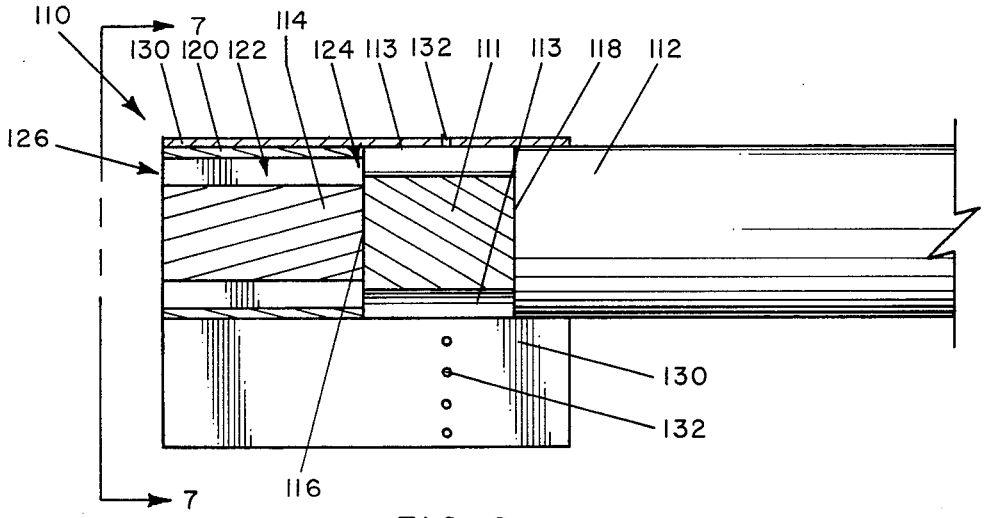
FIG. 6 is a longitudinal cross-sectional view in the direction of arrows 6—6 in FIG. 5; and, FIG. 7 is an end view of the mouthpiece as viewed in the direction of arrows 7—7 in FIG. 6.
Figure 7:
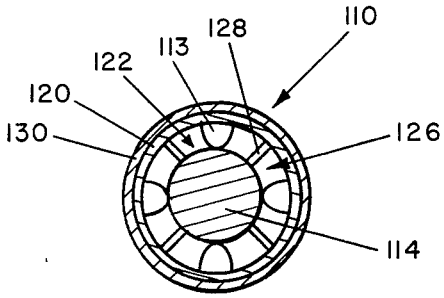

Referring now to FIGS. 5 through 7, there is shown another advantageous embodiment of a mouthpiece, generally denoted as the numeral 110, attached to a tobacco column 12.

The mouthpiece 110 is shown as including a generally cylindrically shaped filter plug 111 having generally the same diameter as the tobacco column 12 coaxially located at one end 118 of the tobacco column 12 and in juxtaposition thereto. Formed in the peripheral surface of the filter plug 111 are a plurality of generally longitudinally extending grooves 113 extending from one end to the other end of the filter plug 111. The grooves are shown as being spaced apart circumferentially of the filter plug 111. An air and smoke impermeable core member 114 having at least one generally circular end 116 of a smaller diameter than the filter plug 111 is located with its at least one circular end 116 in coaxial juxtaposition with the end of the filter plug 111 opposite the tobacco column 12. The area of the circular end 116 of the filter plug 111 should be such size as to not block off the grooves 113. Toward this end, as shown, the diameter of the circular end 116 of the core member 114 is generally equal to twice the radial distance from the longitudinal centerline of the filter plug 111 to the deepest point at the bottom of the grooves 113. The core member 114 is advantageously located such that the peripheral margin of the core member 114 is generally tangential to the deepest point of the grooves 113 at the open end of the grooves at the end of the filter plug 111 in juxtaposition with the circular end 116 of the core member 114. This arrangement results in the peripheral margin of the core member 114 being generally coextensive with the grooves 113. As shown, the core member 114 is cylindrical in shape, however, it is contemplated that other shapes such as, for example, a conical shape can be used. A generally cylindrically shaped sleeve member 120, which is also air and smoke impermeable, having substantially the same outside diameter as the cigarette tobacco column 12 and an inside diameter greater than the diameter of the circular end 116 of the core member 114 is concentrically located over the core member 114 and cooperates with the core member to define an annular channel 122. The annular channel 122 is open at both of its ends 124 and 126. One open channel end 124 is open to the end of the filter plug 111 opposite the tobacco column 12 and the other open channel end 126 is open to the mouth end of the mouthpiece 110. As shown, the sleeve member 120 is longitudinally coextensive with the core member 114. Support means, such as a plurality of spaced apart, generally radially extending webs 128 interconnecting the core member 114 and sleeve member 120 across the annular channel 122 hold the sleeve member 120 in position over the core member 114. Preferably, the webs 128 are integrally formed with the core member 114 and sleeve member 120.

The core member 114, sleeve member 120 and webs 128 can be manufactured by extrusion and fabricated of virtually any air and smoke impermeable material, such as, for example, a plastic.

The core member 114 can be fabricated of virtually any material, for example, an impermeable plastic material or a material which provides a high pressure drop longitudinally across the filter plug 111 such as a very dense cellulose acetate filter bundle.

Tipping material 130, for example, of the type known in the art, such as a sheet of paper, circumferentially surrounds the filter plug 111, at least a portion of the sleeve member 120 and overlaps at least the portion of the tobacco column 12 adjacent to the filter plug 111 attaching the mouthpiece 110 to the tobacco column 12. As is well known in the art, the tipping material 130 can be secured to the sleeve member 120, filter plug 111 and tobacco column 12 by an adhesive.

At least the portion of the tipping material surrounding the filter plug 111 is air permeable. As shown in FIGS. 5 and 6, this air permeability is obtained by, for example, small air flow perforations 132 formed through the tipping material 130 communicating with the grooves 113 of the filter plug 111.

It has been found that to assure secure fastening of the sleeve member 120 to the filter plug 111 it is advantageous to employ a layer (not shown) circumscribing both the sleeve member 120 and filter plug 111 beneath the tipping material 130. An example of such a wrapper material is air permeable plug wrap.

When a smoker draws on the mouthpiece 110, ventilating air is drawn into the grooves 113 of the filter plug 111 through the perforations 130 in the tipping material. Concurrently, smoke is drawn into the grooves 113 through the open ends of the grooves 113 wherein the smoke is diluted by the air. The diluted smoke flows from the grooves 113 into the open channel end 124 and leaves the annular channel through the opposite open annular channel end 126 entering the smoker's mouth in a concentrated toroidally shaped stream from the periphery of the mouth end of the mouthpiece 110. The preferred generally coextensive arrangement of the peripheral margin of the core member 114 and grooves 113 provides for a smooth flow of diluted smoke from the grooves 113 into the annular channel 22.

The foregoing detailed description is given primarily for clearness of understanding and no unnecessary limitations should be understood therefrom for modifications will become obvious to one skilled in the art upon reading this disclosure and may be made without departing from the spirit of the invention or scope of the appended claims.

What is claimed is:

1. A mouthpiece adapted to be attached to a cigarette tobacco column comprising:

a generally cylindrically shaped filter plug adapted to be coaxially located at one end of the cigarette tobacco column, the filter plug having substantially the same diameter as the tobacco column;

means defining a plurality of generally longitudinally extending grooves in the peripheral surface of the filter plug, the grooves extending from one end to the other end of the filter plug;

an air and smoke impermeable core member having at least one end of generally circular shape of a diameter smaller than the diameter of the filter plug coaxially disposed to the end of the filter plug opposite the tobacco column with the at least one circular end in juxtaposition with the end of the filter plug;

a generally cylindrically shaped hollow air and smoke impermeable sleeve having substantially the same diameter as the filter plug concentrically located over the core member and cooperating therewith to define an annular channel open at both of its ends; and, means for supporting the sleeve member in position over the core member.

2. The mouthpiece of claim 1, wherein the diameter of the circular end of the core member in juxtaposition with the one end of the filter plug is approximately equal to twice the radial distance from the longitudinal centerline of the filter plug to the deepest point at the bottom of the grooves.

3. The mouthpiece of claim 2, wherein the peripheral margin of the core member is generally tangential to the deepest point of the grooves at the open end of the grooves at that end of the filter plug in juxtaposition with the circular end of the core member.

4. The mouthpiece of claim 1, wherein the sleeve support means comprises at least one web member interconnecting the sleeve member and core member.

5. The mouthpiece of claim 1, wherein the sleeve member is generally longitudinally coextensive with the core member.

6. A cigarette comprising:

a generally cylindrically shaped tobacco column;

a generally cylindrically shaped filter plug located coaxially to one end of the tobacco column, the filter plug having substantially the same diameter as the tobacco column;

means defining a plurality of generally longitudinally extending grooves in the peripheral surface of the filter plug, the grooves extending from one end to the other end of the filter plug;

an air and smoke impermeable core member having at least one end of generally circular shape of a diameter smaller than the diameter of the filter plug coaxially disposed to the end of the filter plug opposite the tobacco column with the at least one circular end in juxtaposition with the end of the filter plug;

a generally cylindrically shaped, hollow, air and smoke impermeable sleeve having substantially the same diameter as the filter plug concentrically located over the core member and cooperating therewith to define an annular channel open at both of its ends;

means for supporting the sleeve member in position over the core member;

tipping material circumferentially surrounding the filter plug, at least a portion of the sleeve member and overlapping at least a portion of the tobacco column adjacent to the filter plug attaching the sleeve member and filter plug to the tobacco column.

7. The cigarette of claim 6, further comprising means providing for the flow of ambient air into the grooves formed in the periphery of the filter plug.

8. The cigarette of claim 7, wherein the flow means comprises the tipping material being air permeable at least over a portion of the grooves of the filter plug.

9. The cigarette of claim 8, wherein the air permeability is provided by perforations formed through the tipping material.

10. The cigarette of claim 6, wherein the diameter of the circular end of the core member in juxtaposition with the one end of the filter plug is approximately equal to double the radial distance from the longitudinal centerline of the filter plug to the deepest point at the bottom of the grooves.

* * * * *